US009671203B1

(12) United States Patent
Lee et al.

(10) Patent No.: US 9,671,203 B1
(45) Date of Patent: Jun. 6, 2017

(54) FIRE EXTINGUISHING BULLET SYSTEM FOR LAUNCHING

(71) Applicant: Chang Sung Ace Co., Ltd., Seongnam (KR)

(72) Inventors: Yeu Yong Lee, Seoul (KR); Jong Hee Han, Seoul (KR)

(73) Assignee: CHANG SUNG ACE CO., LTD., Seongnam-si (KR)

( * ) Notice: Subject to any disclaimer, the term of this patent is extended or adjusted under 35 U.S.C. 154(b) by 0 days.

(21) Appl. No.: 15/405,387

(22) Filed: Jan. 13, 2017

(51) Int. Cl.
*F42B 12/46* (2006.01)
*A62C 37/11* (2006.01)

(52) U.S. Cl.
CPC ..... *F42B 12/46* (2013.01); *A62C 37/11* (2013.01)

(58) Field of Classification Search
CPC ..... F42B 12/46; A62C 37/11
USPC ..... 169/46, 36; 124/31, 32
See application file for complete search history.

(56) References Cited

U.S. PATENT DOCUMENTS 13,660 A * 10/1855 Storm ..... F41C 3/14 169/28
7,832,493 B2 * 11/2010 Gross ..... A62C 5/006 102/261
8,746,355 B2 * 6/2014 Demmitt ..... A62C 3/025 102/369
2010/0314139 A1 * 12/2010 Jacobsen ..... A62C 3/025 169/46

FOREIGN PATENT DOCUMENTS

KR 10-0986638 10/2010
KR 10-1243081 3/2013
KR 10-2015-0074337 7/2015

OTHER PUBLICATIONS

Korean Intellectual Property Office, Decision of Rejection(Office Action) of Application No. 10-2015-0162857, Mar. 22, 2016.
Korean Intellectual Property Office, Decision of Rejection(Office Action) of Application No. 10-2015-0162857, Aug. 26, 2016.
Korean Intellectual Property Office, Notice of Allowance of Application No. 10-2015-0162857, Nov. 29, 2016.

* cited by examiner

*Primary Examiner* — Arthur O Hall
*Assistant Examiner* — Steven M Cernoch
(74) *Attorney, Agent, or Firm* — Lex IP Meister, PLLC

(57) ABSTRACT

Disclosed herein is a fire extinguishing bullet system for launching, which is capable of effectively extinguishing a fire generated at a place that is difficult to access by a person by loading a fire extinguishing bullet that generates a fire extinguishing gas having a fire extinguishing effect onto a projectile, throwing the fire extinguishing bullet loaded at a long distance from a firing point to a specific distance, and discharging the fire extinguishing gas after the fire extinguishing bullet reaches the firing point.

11 Claims, 8 Drawing Sheets

FIRE EXTINGUISHING BULLET SYSTEM FOR LAUNCHING

BACKGROUND OF THE INVENTION

1. Technical Field

The present invention relates generally to a fire extinguishing bullet system for launching and, more particularly, to a fire extinguishing bullet system for launching, which is capable of effectively extinguishing a fire generated at a place that is difficult to access by a person by loading a fire extinguishing bullet that generates a fire extinguishing gas having a fire extinguishing effect onto a projectile, throwing the fire extinguishing bullet loaded at a long distance from a firing point to a specific distance, and discharging the fire extinguishing gas after the fire extinguishing bullet reaches the firing point.

2. Description of the Related Art

In general, when a fire is generated at a place, such as a building, a vehicle or a ship, a person directly approaches a firing point and uses a fire extinguisher for spraying a fire extinguishing gas in order to extinguish the fire.

A fire extinguisher, such as that described above, is disposed at a place where a fire is likely to occur. A fire extinguishing agent is discharged through a discharge hose to extinguish a fire.

However, the existing fire extinguisher has a problem in that it is difficult to use if it is difficult for a person to directly approach a firing point due to a flame or a toxic gas or heat generated from the fire.

In order to solve such a problem, a fire extinguisher and fire extinguisher launching apparatus which can be thrown to a specific distance are recently being developed.

A prior art, such as Korean Patent Application Publication No. 10-2012-0056386 entitled "Grenade Style Hand Grenade" (Jun. 4, 2012) or Korean Patent Application Publication No. 10-2007-0101675 entitled "Fire Extinguishing Rocket Bomb for Long Distance Fire Extinguish" (Oct. 17, 2007), is suggested as such a fire extinguishing bullet.

However, the prior art is disadvantageous in that a launching apparatus is very complicated to the extent that it is difficult to apply the launching apparatus to a fire extinguisher launching apparatus or that the launching apparatus may not be easily applied because it is complicated to the extent that it is difficult to practically use the launching apparatus.

Furthermore, there are problems in that accuracy is very low in throwing a long distance because airtight throwing means is not disclosed and it is difficult to repeatedly use the launching apparatus because the launching apparatus is disposable.

Furthermore, there are problems in that although the launching apparatus may be thrown at a long distance, an impact or malfunction is generated because the fire extinguisher is activated in a physical manner and the launching apparatus is corroded due to deterioration or humidity that penetrates the inside of the launching apparatus.

Accordingly, the aforementioned prior art needs to continues to be developed in order to solve such problems.

SUMMARY OF THE INVENTION

Accordingly, the present invention has been made keeping in mind the above problems occurring in the conventional art, and an object of the present invention is to provide a fire extinguishing bullet on which a fire extinguishing agent of a solid state combusted at a specific ignition point or more to generate a combustion gas has been loaded and a fire extinguishing system for launching, which can easily throw the fire extinguishing bullet repeatedly at a long distance using a projectile capable of long distance throwing or launching.

Another object of the present invention is to provide a fire extinguishing bullet system for launching, which can solve a problem very vulnerable to humidity and an impact due to the physical actuation of a fire extinguishing bullet, can be simply kept and used, and can guarantee the rapid throwing of a fire extinguishing bullet.

Yet another object of the present invention is to provide a fire extinguishing bullet system for launching, which can solve a problem attributable to heavy weight and a complex structure of an apparatus generated in the physical control method, can solve a problem in that it is complicated to use the fire extinguishing bullet because a person directly controls the operation of the fire extinguishing bullet, can maintain consistent performance, can minimize a malfunction, and can be easily used.

In accordance with an aspect of the present invention, there is provided a fire extinguishing bullet system for launching, including a fire extinguishing bullet including an exterior box onto which a fire extinguishing agent of a solid state combusted at a specific ignition point or more is loaded within the cylinder of the exterior box and in which spray holes for externally discharging a fire extinguishing gas generated by the ignition of the fire extinguishing agent have been formed, the exterior box including activation means for igniting the fire extinguishing agent, and a connection unit inserted into the bottom of the exterior box and located under the fire extinguishing agent, the connection unit including control means connected to the activation means and for actuating the activation means; and a projectile including a gun barrel having the fire extinguishing bullet loaded thereon within the gun barrel, projectile means for providing a projectile force to the fire extinguishing bullet loaded onto the gun barrel, and a magnet having magnetism, attached to the bottom surface of the gun barrel and configured to set whether the control means is to operate in order of loading and launching of the fire extinguishing bullet. The control means of the fire extinguishing bullet includes a sensing unit for recognizing the magnet and a processor for instructing the activation means to operate in order in which the sensing unit recognizes the magnet and the recognition of the magnet by the sensing unit is released. When an attachment piece, that is, an iron plate disposed on the bottom surface of the fire extinguishing bullet in order to prevent the fire extinguishing bullet from being randomly fluctuated within the gun barrel having the fire extinguishing bullet loaded thereon is attached to the magnet, the sensing unit recognizes the magnet. When the attachment piece is detached from the magnet by the projectile means, the recognition of the magnet by the sensing unit is released.

The sensing unit includes a lead switch for recognizing the magnet of the gun barrel.

Furthermore, the magnet has a ring form and is attached to the inside or outside of the bottom of the gun barrel.

Furthermore, the projectile means provides the projectile force to the fire extinguishing bullet by a projectile bullet of a gunpowder ignition method.

Furthermore, the projectile means further includes an inflow hole at the bottom of the gun barrel, and a projectile gas generated by the ignition of gunpowder of the projectile bullet is introduced into the gun barrel through the inflow hole.

Furthermore, the fire extinguishing agent includes a solid aerosol filler. The solid aerosol includes 45 to 80 wt % of potassium nitrate (KNO3), 15 to 50 wt % of epoxy resin, 0.5 to 5 wt % of a surfactant and 0.5 to 5 wt % of a catalyst.

Furthermore, the activation means includes an ignition unit immersed in the loaded fire extinguishing agent and an activation unit configured to heat the ignition unit to the ignition point or more of the fire extinguishing agent.

The activation unit is connected to the control means and driven in response to an instruction from the control means.

Furthermore, the ignition unit includes a hot wire or resistor heated to the ignition point or more by the activation unit. The ignition unit is immersed in the center of the fire extinguishing agent loaded within the exterior box.

Furthermore, the fire extinguishing bullet system further includes a circular separation plate disposed between the fire extinguishing agent and the control means and configured to prevent gas of the fire extinguishing agent from penetrating the control means. The outer circumference surface of the control means is filled with an insulator in order to prevent a transfer of radiant heat.

Furthermore, the control means further includes a battery for storing an electric current to be supplied to the activation unit.

Furthermore, the control means further includes a timer for enabling the activation unit to operate after a lapse of a specific time.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF REFERENCE NUMERALS

Figure 1:
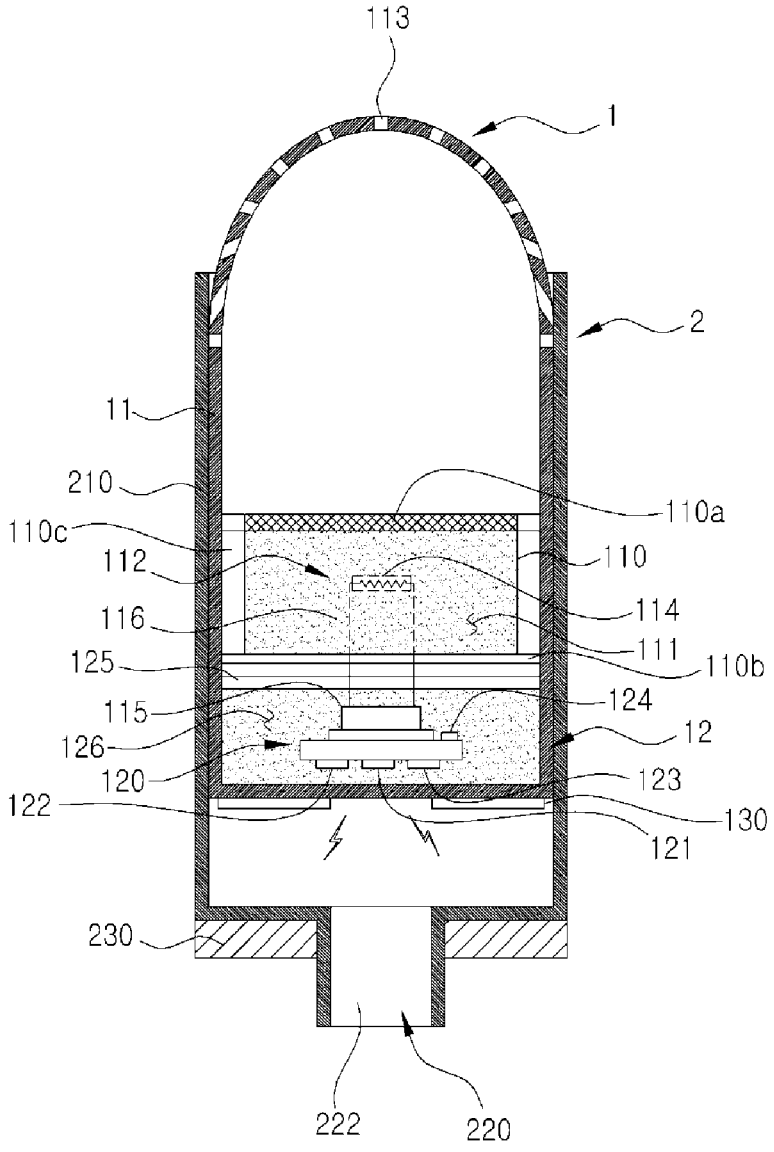
FIG. 1 is a cross-sectional view showing a fire extinguishing bullet system for launching according to an embodiment of the present invention.

1: fire extinguishing bullet
2: projectile
11: exterior box
12: connection unit
111: fire extinguishing agent
112: activation means
113: spray holes
114: activation unit
115: activation unit
120: control means
121: sensing unit
122: processor
123: battery
124: timer
130: metal body
210: gun barrel
220: projectile means
230: setting unit
S100: loading step
S200: percussion step
S300: actuation step
S400: generation step
S110: sensing step
S120: activation step
S130: waiting step

DESCRIPTION OF THE PREFERRED EMBODIMENTS

The merits and characteristics of the present invention and methods for achieving the merits and characteristics will become evident from embodiments described in detail later in conjunction with the accompanying drawings.

However, the present invention is not limited to the disclosed embodiments, but may be implemented in various different ways. The embodiments are provided to only complete the disclosure of the present invention and to allow a person having ordinary skill in the art to which the present invention pertains to completely understand the category of the invention. The present invention is only defined by the category of the claims. The same reference numerals will be used to refer to the same or similar elements throughout the drawings.

A fire extinguishing bullet according to an embodiment of the present invention is described below with reference to the accompanying drawings.

Figure 2:
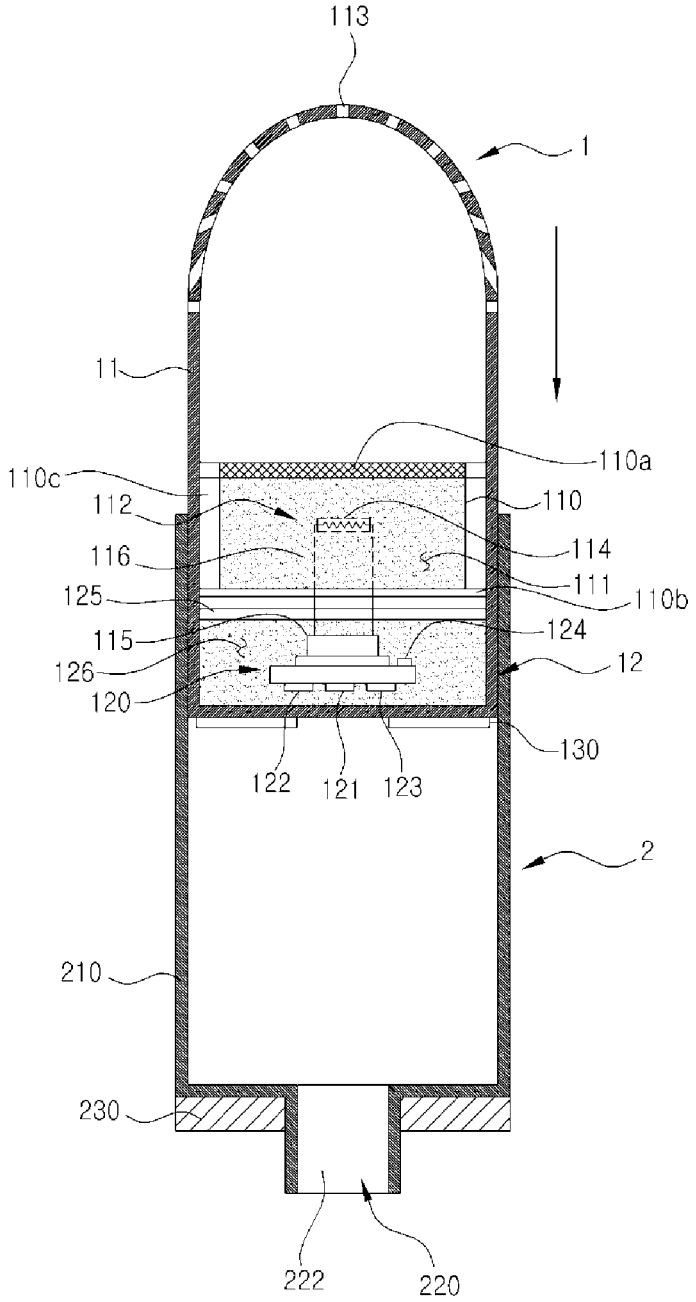
FIG. 2 is a cross-sectional view showing the state in which the fire extinguishing bullet system for launching has been mounted according to an embodiment of the present invention.
Figure 3:
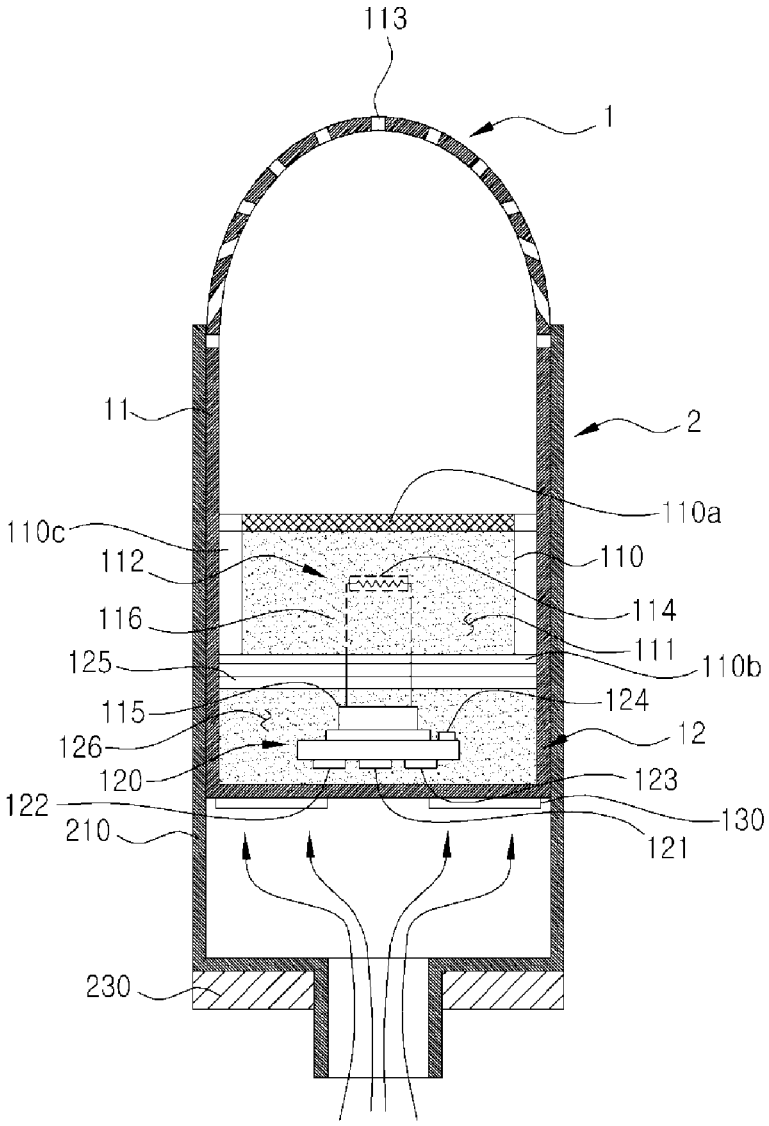
FIG. 3 is a cross-sectional view showing the state in which the fire extinguishing bullet system for launching has been launched according to an embodiment of the present invention.
Figure 4:
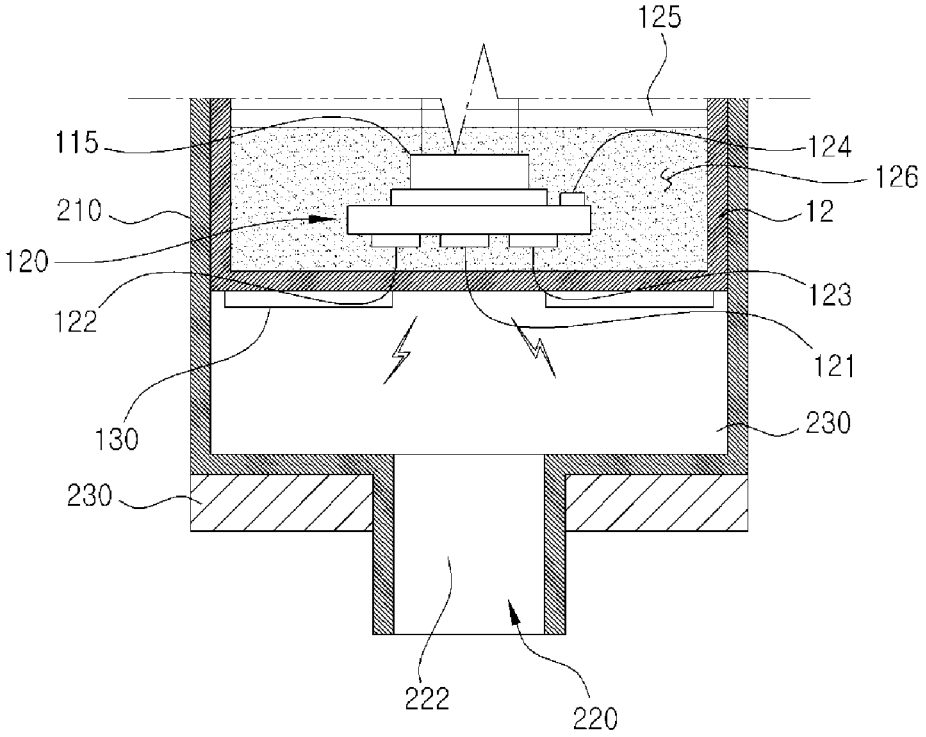
FIG. 4 is a cross-sectional view showing the operation of a sensing unit that is one of the elements of the fire extinguishing bullet system for launching according to an embodiment of the present invention.
Figure 5:
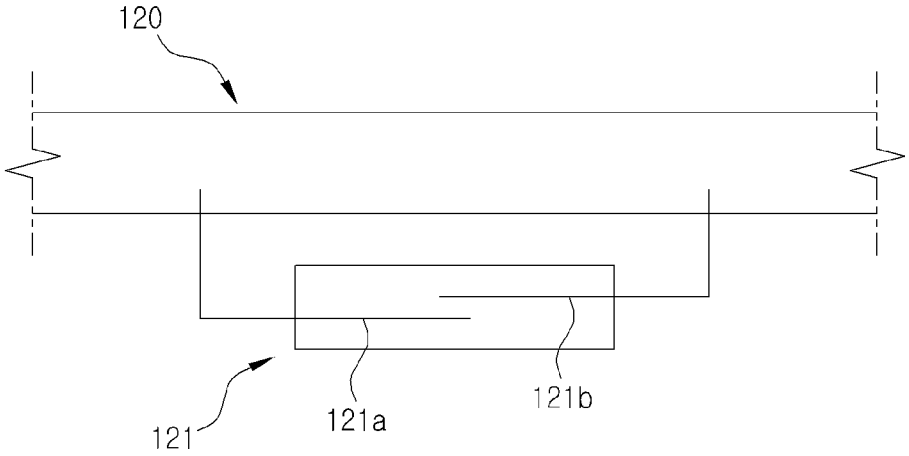
FIG. 5 is an enlarged view showing the sensing unit that is one of the elements of the fire extinguishing bullet system for launching according to an embodiment of the present invention.

FIG. 1 is a cross-sectional view showing a fire extinguishing bullet system for launching according to an embodiment of the present invention. FIG. 2 is a cross-sectional view showing the state in which the fire extinguishing bullet system for launching has been mounted according to an embodiment of the present invention. FIG. 3 is a cross-sectional view showing the state in which the fire extinguishing bullet system for launching has been launched according to an embodiment of the present invention. FIG. 4 is a cross-sectional view showing the operation of a sensing unit that is one of the elements of the fire extinguishing bullet system for launching according to an embodiment of the present invention. FIG. 5 is an enlarged view showing the sensing unit that is one of the elements of the fire extinguishing bullet system for launching according to an embodiment of the present invention.

First, an embodiment of the present invention relates to a fire extinguishing bullet system for launching, which can load a fire extinguishing bullet 1 that generates a fire extinguishing gas having a fire extinguishing effect onto a projectile 2 and launches the loaded fire extinguishing bullet 1 at a specific distance. The fire extinguishing bullet system for launching according to an embodiment of the present invention includes the fire extinguishing bullet 1 and the projectile 2.

In the fire extinguishing bullet system for launching, the fire extinguishing bullet 1 includes an exterior box 11 and a connection unit 12.

The exterior box 11 has a cylinder form. A fire extinguishing agent 111 that is a solid at normal temperature and combusted at a specific ignition point or more is loaded onto the exterior box 11. The exterior box 11 includes activation means 112 for igniting the fire extinguishing agent 111. The bottom of the exterior box 11 is closed, whereas spray holes 113 for externally discharging a fire extinguishing gas generated by the ignition of the fire extinguishing agent 111 are formed at the top of the exterior box 11.

The connection unit 12 includes control means 120 connected to the activation means 112 and configured to activate the activation means. The connection unit 12 is inserted into the bottom of the exterior box 11 and located under the fire extinguishing agent 111.

The connection unit 12 is connected to the activation means 112, inserted into the bottom of the exterior box, and located under the fire extinguishing agent 111. More specifically, the connection unit 12 is located on the bottom surface of the exterior box 11, and generally has a structure in which the connection unit 12 and the fire extinguishing agent 111 are sequentially seated from the bottom surface of the exterior box. The fire extinguishing bullet 1 has an overall shell form.

Furthermore, the connection unit 12 includes the control means 120 for activating the activation means 112.

In this case, the control means 120 is located under the activation means 112 and connected to the activation means 112. More specifically, the control means 120 may include a processor 122 connected to the activation means 112. The processor 122 activates the operation of the activation means 112 at a place where a fire is generated so that the ignition of the fire extinguishing agent 111 is induced, and deactivates the operation of the activation means 112 at other places so that the fire extinguishing agent 111 is not ignited.

The projectile 2 launches the fire extinguishing bullet 1 forward in the state in which the fire extinguishing bullet 1 has been loaded thereon. The projectile 2 according to an embodiment of the present invention includes a gun barrel 210, projectile means 220 and a setting unit 230.

The gun barrel 210 is a tube of a cylinder form on which the fire extinguishing bullet 1 can be loaded. The projectile means 220 for providing a projectile force so that the fire extinguishing bullet 1 can be launched forward and the setting unit 230 for setting whether the control means 120 will operate or not are provided at the bottom of the gun barrel 210.

More specifically, the gun barrel 210 has an outer circumference surface diameter approximately identical with the outer circumference surface diameter of the fire extinguishing bullet 1. In this case, the top of the gun barrel 210 is open so that the fire extinguishing bullet 1 is inserted into the gun barrel 210 or fired and detached outward.

Furthermore, the gun barrel 210 may have a length so that when the fire extinguishing bullet 1 is loaded onto the gun barrel 210, part of the upper side of the fire extinguishing bullet 1 is partially protruded upward from the gun barrel 210 and thus a user can check that the fire extinguishing bullet 1 has been loaded onto the gun barrel 210.

Furthermore, the projectile means 220 for providing a projectile force to the fire extinguishing bullet 1 is provided at the bottom of the gun barrel 210.

The projectile means 220 provides a projectile force to the fire extinguishing bullet 1 loaded onto the gun barrel 210. Various projectile means 220, such as an air compression method, a spring compression method and a gunpowder ignition method, may be used. In this case, the projectile means 220 may communicate from the outside of the gun barrel 210 to the bottom or may have only to be easily located within the gun barrel 210. For example, the projectile means 220 may use a gunpowder ignition method which can be easily applied by taking into consideration the reloadable ability and the accuracy of an operation.

In an embodiment of the present invention, the projectile means 220 using the gunpowder ignition method has been illustrated.

As shown in FIG. 3, the projectile means 220 using the gunpowder ignition method according to an embodiment of the present invention generates a projectile gas in response to the ignition of gunpowder, and may include an inflow hole 222 for introducing the projectile force of the projectile gas into the gun barrel 210 of the projectile 2 and transferring the projectile force to the fire extinguishing bullet 1 loaded onto the gun barrel 210.

More specifically, the inflow hole 222 is a through hole formed at the bottom of the gun barrel 210. The projectile gas introduced into the gun barrel 210 through the inflow hole 222 pushes the fire extinguishing bullet 1, and the fire extinguishing bullet 1 to which the projectile force has been applied is launched to the outside of the gun barrel 210. To this end, the projectile gas may be used in a projectile bullet (not shown) having the gunpowder ignition method. The projectile gas is generated by the projectile bullet (not shown) by the ignition of gunpowder of the projectile bullet (not shown), and thus the projectile gas can be delivered to the fire extinguishing bullet 1.

Furthermore, the setting unit 230 of the projectile 2 sets whether the control means 120 of the projectile 2 will operate depending on the loading or launching state of the projectile 2 led into the gun barrel 210. That is, when the fire extinguishing bullet 1 is inserted into the gun barrel 210, the control means 120 of the fire extinguishing bullet 1 recognizes the setting unit 230. More specifically, in order to recognize the setting unit 230, the control means 120 further includes a sensing unit 121 capable of recognizing the setting unit 230.

That is, the control means 120 of the fire extinguishing bullet 1 includes the sensing unit 121, and the sensing unit 121 and the processor 122 are connected. In this case, a lead switch, a photo sensor or a differential pressure sensor for electronically recognizing the setting unit 230 may be used as the sensing unit 121. The sensing unit 121 of the fire extinguishing bullet 1 recognizes the setting unit 230 so that the processor 122 of the control means 120 can instruct the activation means 112 to wait or can given an instruction to the activation means 112.

In an embodiment of the present invention, the sensing unit 121 may be a lead switch for recognizing the setting unit 230 of the gun barrel 210. The setting unit 230 has been illustrated as being a magnet having magnetism so that the lead switch is recognized.

FIG. 4 is a cross-sectional view showing the operation of the sensing unit that is one of the elements of the fire extinguishing bullet system for launching according to an embodiment of the present invention. FIG. 5 is an enlarged view showing the sensing unit that is one of the elements of the fire extinguishing bullet system for launching according to an embodiment of the present invention. As shown, the magnet may be fixed to the outside of the bottom of the gun barrel 210. More specifically, the magnet may be a permanent magnet or an electromagnet. The magnet may have a ring form to surround the inflow hole 222 formed at the bottom of the gun barrel 210 and may be fixed along the outer circumference surface of the inflow hole 222. The fire extinguishing bullet 1 is led into the gun barrel 210 through the magnet. The lead switch arrives near the magnet fixed to the bottom of the gun barrel 210. The lead switch recognizes the magnet and transfers a recognition signal to the processor 122. The processor 122 to which the recognition signal has been transferred switches from an inactive state to an active state and operates.

More specifically, two contact point terminals 121*a* and 121*b* spaced apart from each other are disposed within the lead switch. When the magnet arrives near the two contact point terminals 121*a* and 121*b*, the two contact point terminals 121*a* and 121*b* come into contact with each other due to magnetism. The contacted two contact point terminals 121*a* and 121*b* are electrified, thereby transferring a corresponding signal.

Furthermore, the lead switch has a small size and has very low consumption power. Accordingly, the size of the lead switch can be easily adjusted in applying the lead switch to an embodiment of the present invention and it may be very easy upon maintenance and management. Furthermore, the lead switch can improve the accuracy of an operation because it has fine recognition by the magnet and has high speed. Furthermore, there is an advantage in that the lead switch can prevent a malfunction because it is strong against humidity or corrosion.

Figure 6:
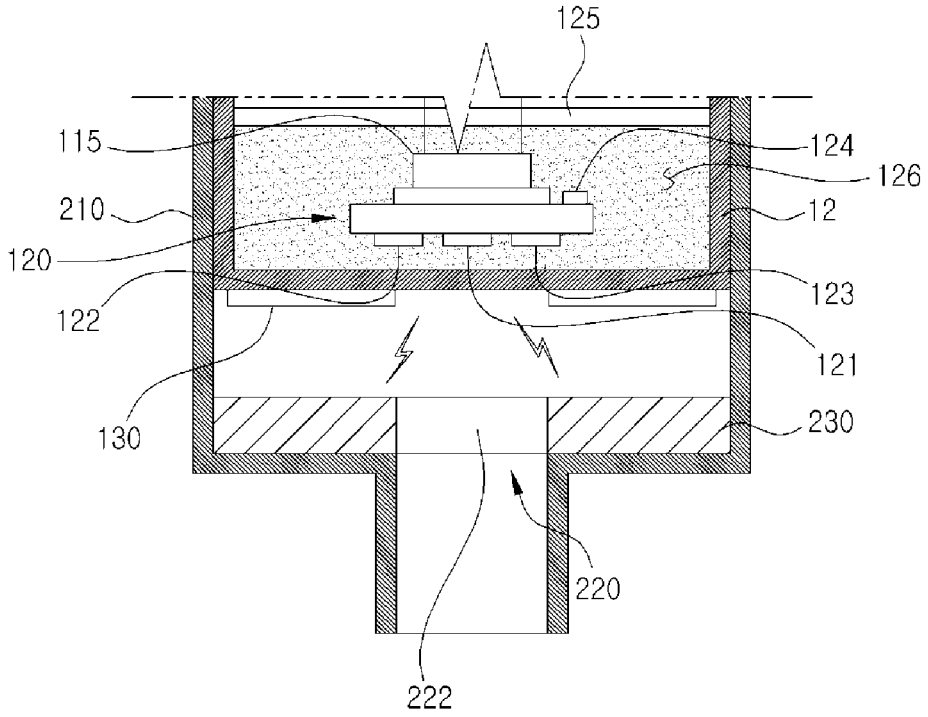
FIG. 6 is a cross-sectional view showing a sensing unit and a setting unit that are elements of the fire extinguishing bullet system for launching according to another embodiment of the present invention.

FIG. 6 is a cross-sectional view showing the sensing unit and the setting unit that are elements of the fire extinguishing bullet system for launching according to another embodiment of the present invention. The setting unit 230 formed of the magnet may be fixed to the inside of the bottom of the gun barrel. If the setting unit 230 is fixed to the inside of the bottom of the gun barrel 210, the diameter and outward appearance of the setting unit 230 may be changed depending on a form of the inflow hole 222. In this case, a change in the diameter and outward appearance may be sufficiently understood by those skilled in the art, and a detailed description of the diameter and outward appearance is omitted.

An attachment piece 130 which may be detachably attached to the setting unit 230 may be further provided on the lower side of the fire extinguishing bullet 1. More specifically, the attachment piece 130 is a circular iron plate. The attachment piece 130 having a size approximately corresponding to the diameter of the bottom surface of the fire extinguishing bullet 1 may be fixed to the bottom of the fire extinguishing bullet 1.

That is, there are advantages in that since the attachment piece 130 is attached to the magnet, the fire extinguishing bullet 1 can be prevented from being randomly detached from the bottom of the gun barrel 210, the fire extinguishing bullet 1 can be easily loaded onto the projectile 2 and the state in which the fire extinguishing bullet 1 has been loaded onto the projectile 2 can be maintained.

Furthermore, a fire extinguishing agent 111 that is a solid at normal temperature and that is combusted at a specific ignition point or more is loaded onto the inside of the exterior box 11. More specifically, a fire extinguishing agent accommodation box 110 having a mesh network 110*a* is provided within the exterior box 11 on the upper side thereof. The fire extinguishing agent 111 is loaded onto the inside of the fire extinguishing agent accommodation box 110. In the fire extinguishing agent accommodation box 110, a circular plate 110*b* that partitions the internal space of the exterior box 11 forms the bottom of the fire extinguishing agent accommodation box 110 and the mesh network 110*a* forms the top of the fire extinguishing agent accommodation box 110, thus being capable of forming a loading space 110*c*.

That is, the circular plate 110*b* may include a small hole (not shown) having the same diameter as a leading wire or an electric wire so that the leading wire or electric wire passes through the small hole.

In this case, the fire extinguishing agent 111 is loaded onto the loading space 110*c*, and the fire extinguishing agent 111 may have a solid state having an excellent storage property.

More specifically, the fire extinguishing agent 111 may include a solid aerosol filler. The solid aerosol includes 45 to 80 wt % of potassium nitrate KNO3, 15 to 50 wt % of epoxy resin, 0.5 to 5 wt % of a surfactant and 0.5 to 5 wt % of a catalyst. The fire extinguishing agent 111 is a solid at normal temperature. When the fire extinguishing agent 111 is heated at a specific temperature or more, it generates a fire extinguishing gas while being vaporized.

Furthermore, the activation means 112 is means for igniting the fire extinguishing agent 111 loaded onto the fire extinguishing agent accommodation box 110. More specifically, the activation means 112 includes an ignition unit 114 configured to be immersed within the fire extinguishing agent 111 loaded onto the fire extinguishing agent accommodation box 110 and an activation unit 115 configured to heat the ignition unit 114 at an ignition point or more of the fire extinguishing agent 111. That is, the activation unit 115 is connected to the control means 120, and heats the ignition unit 114 in response to an instruction from the control means 120. The heated ignition unit 114 combusts the fire extinguishing agent 111 so that the fire extinguishing agent 111 is vaporized.

The ignition unit 114 is formed of a hot wire or resistor that is heated at the ignition point or more by an electric current of a specific intensity or more. The ignition unit 114 is immersed at the central part of the fire extinguishing agent 111 loaded onto the fire extinguishing agent accommodation box 110. In this case, the activation unit 115 may have a structure, including a socket connected to the hot wire or resistor through a connection wire so that the activation unit 115 supplies the electric current to the hot wire or resistor and also connected to the control means 120 so that the socket has a simple coupling method when the fire extinguishing bullet is fabricated and a terminal mounted on the socket and connected to the activation unit 115 through the connection wire.

In this case, the control means 120 applies the electric current so that the ignition unit 114 generates heat, so high-temperature radiant heat, gas and pressure are generated. In this case, in order to protect the control means 120 from the radiant heat, gas and pressure, a circular separation plate 125 may be further provided between the fire extinguishing agent 111 in which the ignition unit 114 has been immersed and the control means 120, thus being capable of preventing the gas from being penetrated into the control means 120.

Furthermore, an insulator 126 is filled in the outer circumference surface of the control means 120 in order to prevent the control means 120 from being damaged by the radiant heat. Accordingly, the control means 120 can be protected against an external impact because the lower side of the exterior box 11 is filled with the insulator 126.

The control means 120 further includes a battery 123 for storing an electric current to be supplied to the activation unit 115. That is, the battery 123 supplies the electric current to the activation unit 115. The activation unit 115 can heat the ignition unit 114 in response to an instruction from the control means 120 so that the ignition unit 114 is heated at the ignition point or more.

Furthermore, the battery 123 may supply power consumed by the processor 122 of the control means 120. At this time, the processor 122 switches from an inactive state to an active state when the setting unit 230 of the sensing unit 121 is recognized. At this time, the battery 123 supplies an electric current used by the processor 122.

The control means 120 further includes a timer 124 that enables the activation unit 115 to operate after a lapse of a specific time. More specifically, the activation unit 115 connected to the control means 120 is connected to the timer 124. When the control means 120 gives an instruction to the activation unit 115, the activation unit 115 is supplied with power from the battery 123 after a lapse of a specific time set in the timer 124, and thus heats the ignition unit 114.

According to an embodiment of the present invention, when the fire extinguishing bullet 1 loaded onto the projectile is launched, the fire extinguishing agent 111 is ignited after a lapse of a specific time. When the fire extinguishing bullet 1 reaches a specific place, a fire extinguishing gas can be discharged.

A method for controlling the fire extinguishing bullet system for launching according to an embodiment of the present invention is described in detail below.

An embodiment of the present invention relates to a method for controlling the fire extinguishing bullet system, including loading the fire extinguishing bullet 1 for generating a fire extinguishing gas onto the projectile 2 and launching the loaded fire extinguishing bullet 1 at a specific distance.

Figure 7:
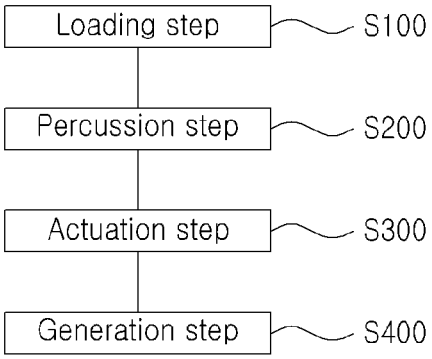
FIG. 7 is a flowchart illustrating the operation of the fire extinguishing bullet system for launching according to an embodiment of the present invention.
Figure 8:
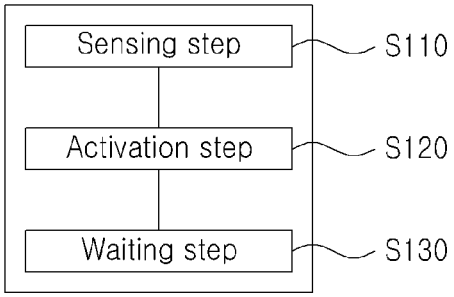
FIG. 8 is a detailed flowchart illustrating a loading step according to an embodiment of the present invention.

FIG. 7 is a flowchart illustrating the operation of the fire extinguishing bullet system for launching according to an embodiment of the present invention. FIG. 8 is a detailed flowchart illustrating a loading step according to an embodiment of the present invention.

As shown in FIG. 7, the method for controlling the fire extinguishing bullet system basically includes a loading step S100, a percussion step S200, an actuation step S300, and a generation step S400.

In this case, in the loading step S100, the fire extinguishing bullet 1 is loaded onto the gun barrel 210 of the projectile 2. The fire extinguishing bullet 1 is lead in the gun barrel 210 of a cylinder form and located on the lower side of the gun barrel 210.

In the percussion step S200, a projectile force generated by the projectile means 220 is transferred to the fire extinguishing bullet 1 so that the fire extinguishing bullet 1 is detached from the projectile 2 onto which the fire extinguishing bullet 1 has been loaded.

In this case, the gunpowder ignition method according to an embodiment of the present invention may be applied to the projectile means 220. More specifically, the gunpowder ignition method may be applied to a projectile bullet (not shown) including gunpowder. In this case, the launching distance of the fire extinguishing bullet 1 can be adjusted depending on the amount of gunpowder that is ignited within the projectile bullet (not shown). The amount of gunpowder can be easily adjusted by those skilled in the art and a detailed description thereof is omitted.

In the actuation step S300, the fire extinguishing bullet 1 to which the projectile force of the projectile gas generated in the percussion step S200 has been applied is detached from the gun barrel 210.

More specifically, when the fire extinguishing bullet 1 is detached from the gun barrel 210, the control means 120 of the fire extinguishing bullet 1, more specifically, the state in which the sensing unit 121 recognizes the setting unit 230 of the projectile 2 is released. Accordingly, the processor 122 can be actuated.

Furthermore, the generation step S400 includes a process for generating the fire extinguishing gas from the fire extinguishing agent 111 provided within the fire extinguishing bullet 1 in response to the actuation of the fire extinguishing bullet 1.

Through such a process, the fire extinguishing bullet system for launching can be controlled using the projectile 2. In this case, the method for controlling the fire extinguishing bullet system for launching according to an embodiment of the present invention may further include the following characteristics different from an existing control method.

Furthermore, as shown in FIG. 8, in the method for controlling the fire extinguishing bullet for launching according to an embodiment of the present invention, the loading step S100 may include a sensing step S110, an activation step S120, and a waiting step S130.

In the sensing step S110, when the fire extinguishing bullet 1 is led into the gun barrel 210, the control means 120 of the fire extinguishing bullet 1 recognizes the gun barrel 210 of the projectile 2.

More specifically, the sensing unit 121 connected to the control means 120 of the fire extinguishing bullet 1 may recognize the setting unit 230 disposed within the gun barrel 210 of the projectile 2. In this case, the sensing unit 121 may be a lead switch, and the setting unit 230 may be a magnet. That is, the two contact point terminals 121*a* and 121*b* spaced apart from each other are disposed within the lead switch. When the magnet approaches nearby, the spaced two contact point terminals 121*a* and 121*b* come into contact with each other due to the magnetism of the magnet. The contacted two contact point terminals 121*a* and 121*b* become electrified.

In the activation step S120, the gun barrel 210 of the projectile 2 is recognized and the processor 122 of the control means 120 is activated. In this case, the activation means that the processor 122 switches from the state in which it does not operate to a state in which it may operate. That is, when the control means 120 of the fire extinguishing bullet 1 recognizes the setting unit 230 of the gun barrel 210, power is supplied by the battery 123 connected to the control means 120. Accordingly, the processor 122 switches from the non-operation state to the operation state.

Furthermore, in the waiting step S130, the activated processor 122 enables the activation unit 115 for generating a fire extinguishing gas to wait for its operation. More specifically, the processor 122 can enable the activation unit 115 for generating a fire extinguishing gas to wait for its operation by blocking power supplied to the activation unit 115.

Furthermore, in the generation step S400 of generating a fire extinguishing gas, the activation unit 115 is supplied with power from the battery 123, and the activation unit 115 heats the ignition unit 114 to an ignition point or more. Thereafter, when the ignition unit 114 is heated to the ignition point or more, the fire extinguishing agent 111 is ignited, thereby generating a fire extinguishing gas.

In this case, after a lapse of a specific time set in the timer 124, the activation unit 115 is supplied with power from the battery 123 and may raise the ignition unit 114 to the ignition point or more of the fire extinguishing agent 111. That is, the activation unit 115 connected to the timer 124 waits for the heating of the ignition unit 114 during a time set in the timer 124. After the time set in the timer 124 elapses, the activation unit 115 may heat the ignition unit 114 to the ignition point or more of the fire extinguishing agent 111.

As described above, the fire extinguishing bullet system for launching according to an embodiment of the present invention has an advantage in that it can effectively extinguish a fire generated at a place that is difficult to access by a person because the fire extinguishing bullet is launched at the distance distant from a firing point so that the fire extinguishing bullet is thrown at the firing point and a fire extinguishing gas is discharged from the fire extinguishing bullet after the fire extinguishing bullet reaches the firing point.

Furthermore, there are advantages in that the fire extinguishing bullet can be simply stored and used and can be rapidly thrown by solving a problem very vulnerable to humidity and an impact due to the physical actuation of the fire extinguishing bullet.

Furthermore, there is an advantage in that a structure is simple so that it has a minimized weight and size by solving heavy weight and a complex structure of a fire extinguishing bullet generated in a physical control method. Furthermore, there is an advantage in that performance can continue to be maintained and a malfunction can be minimized by automatically controlling the operation of the fire extinguishing bullet.

Those skilled in the art to which the present invention pertains will appreciate that the present invention may be implemented in other detailed forms without departing from the technological spirit or essential characteristics of the present invention. Accordingly, the aforementioned embodiments should be understood as being only illustrative, but should not be understood as being restrictive from all aspects. The range of right of the present invention is defined by the following claims rather than the detailed description, and the meanings and scope of the claims and all changes or modified forms derived from their equivalents should be construed as falling within the range of right of the present invention.

What is claimed is:

1. A fire extinguishing bullet system for launching, comprising:

a fire extinguishing bullet comprising an exterior box onto which a fire extinguishing agent of a solid state combusted at a specific ignition point or more is loaded within a cylinder of the exterior box and in which spray holes for externally discharging a fire extinguishing gas generated by an ignition of the fire extinguishing agent have been formed, the exterior box comprising activation means for igniting the fire extinguishing agent, and a connection unit inserted into a bottom of the exterior box and located under the fire extinguishing agent, the connection unit comprising control means connected to the activation means and for actuating the activation means; and a projectile comprising a gun barrel having the fire extinguishing bullet loaded thereon within the gun barrel, projectile means for providing a projectile force to the fire extinguishing bullet loaded onto the gun barrel, and a magnet having magnetism, attached to a bottom surface of the gun barrel and configured to set whether the control means is to operate in order of loading and launching of the fire extinguishing bullet, wherein the control means of the fire extinguishing bullet comprises a sensing unit for recognizing the magnet and a processor for instructing the activation means to operate in order in which the sensing unit recognizes the magnet and the recognition of the magnet by the sensing unit is released, when an attachment piece comprising an iron plate disposed on a bottom surface of the fire extinguishing bullet in order to prevent the fire extinguishing bullet from being randomly fluctuated within the gun barrel onto which the fire extinguishing bullet is loaded is attached to the magnet, the sensing unit recognizes the magnet, and when the attachment piece is detached from the magnet by the projectile means, the recognition of the magnet by the sensing unit is released.

2. The fire extinguishing bullet system of claim 1, wherein the sensing unit comprises a lead switch for recognizing the magnet of the gun barrel.

3. The fire extinguishing bullet system of claim 1, wherein the magnet has a ring form and is attached to an inside or outside of the bottom of the gun barrel.

4. The fire extinguishing bullet system of claim 1, wherein the projectile means provides the projectile force to the fire extinguishing bullet by a projectile bullet of a gunpowder ignition method.

5. The fire extinguishing bullet system of claim 4, wherein:

the projectile means further comprises an inflow hole at the bottom of the gun barrel, and a projectile gas generated by an ignition of gunpowder of the projectile bullet is introduced into the gun barrel through the inflow hole.

6. The fire extinguishing bullet system of claim 1, wherein:

the fire extinguishing agent comprises a solid aerosol filler, and the solid aerosol comprises 45 to 80 wt % of potassium nitrate (KNO3), 15 to 50 wt % of epoxy resin, 0.5 to 5 wt % of a surfactant and 0.5 to 5 wt % of a catalyst.

7. The fire extinguishing bullet system of claim 1, wherein:

the activation means comprises an ignition unit immersed in the loaded fire extinguishing agent and an activation unit configured to heat the ignition unit to an ignition point or more of the fire extinguishing agent, and the activation unit is connected to the control means and driven in response to an instruction from the control means.

8. The fire extinguishing bullet system of claim 7, wherein:

the ignition unit comprises a hot wire or resistor heated to the ignition point or more by the activation unit, and the ignition unit is immersed in a center of the fire extinguishing agent loaded within the exterior box.

9. The fire extinguishing bullet system of claim 1, further comprising a circular separation plate disposed between the fire extinguishing agent and the control means and configured to prevent gas of the fire extinguishing agent from penetrating the control means, wherein an outer circumference surface of the control means is filled with an insulator in order to prevent a transfer of radiant heat.

10. The fire extinguishing bullet system of claim 7, wherein the control means further comprises a battery for storing an electric current to be supplied to the activation unit.

11. The fire extinguishing bullet system of claim 7, wherein the control means further comprises a timer for enabling the activation unit to operate after a lapse of a specific time.

* * * * *